United States Patent [19]

Kohler et al.

[11] 4,394,788

[45] Jul. 26, 1983

[54] RATCHET BEARING FOR SHUTTER SLATS AND THE LIKE

[75] Inventors: Henry G. Kohler; Emeric L. Major, both of San Diego, Calif.

[73] Assignee: Shutter Mart of California, Inc., San Diego, Calif.

[21] Appl. No.: 173,571

[22] Filed: Jul. 30, 1980

[51] Int. Cl.[3] ..... E05D 11/08

[52] U.S. Cl. ..... 16/334; 16/378; 403/93; 403/97; 74/531

[58] Field of Search ..... 74/531; 403/93, 96, 403/97; 16/334, 378, 342; 308/34, 37

[56] References Cited

U.S. PATENT DOCUMENTS 673,000 4/1901 Dyer ..... 16/342
714,959 12/1902 Sloan ..... 16/342
784,104 3/1905 Caley ..... 16/342

FOREIGN PATENT DOCUMENTS 1250349 12/1960 France ..... 16/334
117932 1/1947 Sweden ..... 16/378

*Primary Examiner*—Kenneth Dorner
*Attorney, Agent, or Firm*—Henri J. A. Charmasson

[57] ABSTRACT

A ratchet bearing is provided for mounting the slats in a shutter frame which incorporates directly into the bearing, by virtue of a trunion pin having a ribbed surface which rotates within a bearing collar having inwardly directed detents, a multiple detention action such that when the slat is rotationally opened or closed, the bearing will seat in one of a multiplicity of detent positions so that the shutter will not sag shut or otherwise move after it has been set.

3 Claims, 8 Drawing Figures

FIG. 1
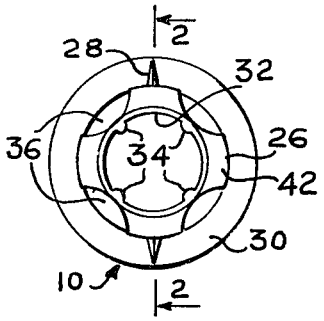
FIG. 2
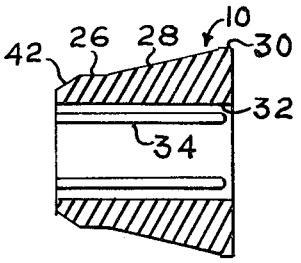
FIG. 3
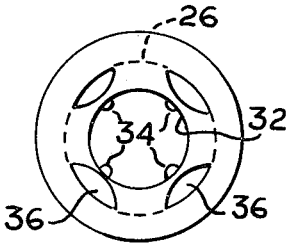
FIG. 4
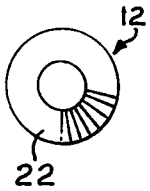
FIG. 5
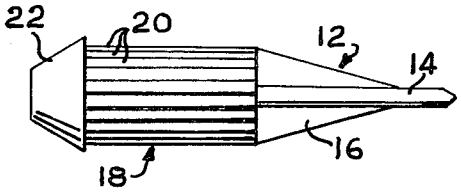
FIG. 6
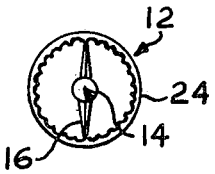
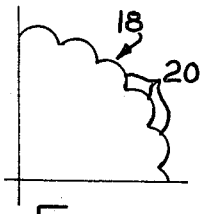
FIG. 7
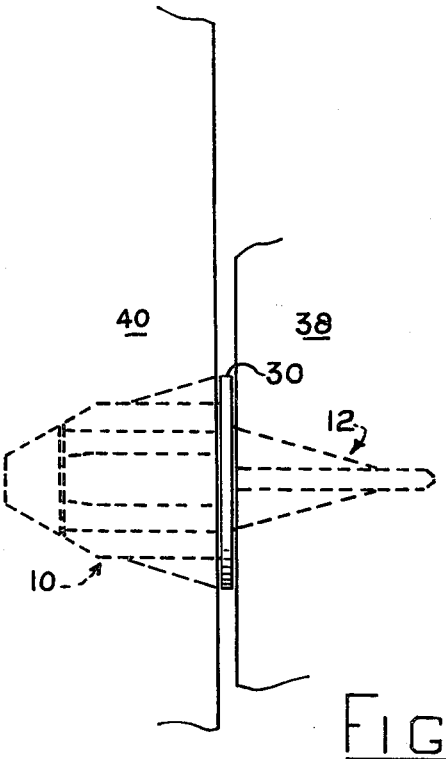
FIG. 8

RATCHET BEARING FOR SHUTTER SLATS AND THE LIKE

BACKGROUND

Typically shutters comprise a series of horizontal, parallel slats which are pivoted in their retaining frame by pins extending from the rotational center of the ends of the slats and which engage, sometimes loosely, in holes or loops defined by the shutter frame.

Adjustment of the shutter is accomplished by one or more vertical connector strips which is loosely connected to each of the shutter slats by horseshoe-shaped brads or the like. Often the weight of these strips is not taken into account when the shutters are designed, so that when the user tries to set the slats at a certain angle, the weight of the connector strip causes them to fall down into the closed, almost vertical orientation again. Although some friction built into the axle pins of the slats may in the beginning defuse this problem, constant wear will often cause it to reemerge with time.

Even aside from the weight of the adjusting strip, other forces such as wind, impact with wind-blown curtains, and encounter by people in the area will cause the shutter slats to slip to a different angle from that at which they were set.

SUMMARY

The present invention completely eliminates this problem by replacing the conventional slat axle pins with a simple but effective ratchet bearing. The bearing comprises a trunion pin having a frustoconical cap and a ribbed cylindrical surface on which rides a bearing collar having detent ridges on its inner surface so that as the collar turns on the trunion pin the detents snap over the ribs in bi-directional ratchet fashion and establish a positive detention of the two elements when rotation is stopped. Installation of the ratchet bearing is installed by simply press-fitting the assembled bearing into bores provided in the slats and shutter frame.

BRIEF DESCRIPTION OF THE DRAWINGS

FIG. 1 is an elevation view of one end of the collar;

FIG. 2 is a section taken along Line 2—2 of FIG. 1;

FIG. 3 is an elevation view of the other end of the collar from that of FIG. 1;

FIG. 4 is an elevational view of the left end of the trunion pin as oriented in FIG. 5;

FIG. 5 is a side elevation view of the trunion pin of FIG. 4;

FIG. 6 is an elevational view of the right end of the trunion pin of FIG. 5;

FIG. 7 is a diagrammatic view of a portion of the ribbed cylindrical surface of the trunion pin of FIGS. 4 through 6;

FIG. 8 is a fragmentary view of a shutter slat installed within a frame showing the hidden portions of the ratchet bearing in dotted line.

DETAILED DESCRIPTION OF THE PREFERRED EMBODIMENT

The trunion pin comes in two basic parts, a bearing collar detailed in FIGS. 1 through 3 at 10 and a trunion pin 12. Both of these elements are preferably molded in a tough, low-friction synthetic substance such as Delrin. The right end of the trunion pin defines the means by which the pin engages into the shutter, constituting a central shaft 14 with oppositely directed converging fins 16. As can be seen in FIG. 6 these fins taper both radially and axially, and are inserted in a hole bored axially into the shutter and being of a size slightly greater than the size of the shaft 14 so when the trunion pin is pressed into the hole, the fins 16 dig into the surrounding wood to define a secure, non-rotational engagement with the shutter.

The central portion of the trunion pin constitutes a generally cylindrical area 18 having a multiplicity of contiguous longitudinal ribs 20 detailed in FIG. 7. Finally, the left end of the trunion pin terminates in a frustoconical cap 22 which defines an orthogonal shoulder 24 adjacent the cylindrical surface 18.

The other element, the bearing collar 10, is also designed to be press-fitted into a bore in the shutter frame, and has an external surface which is basically cylindrical as indicated at 26. The bore is about the same size as this cylindrical surface, and again this surface is provided with tapered fins 28 which dig into the wood of the framing member. The right end of the collar shown in FIG. 2 defines a radially extended circumferential flange 30 which limits the depth of insertion of the collar into the shutter frame and also acts as a thrust washer as will be described hereinafter.

The interior surface 32 of the collar is generally cylindrical also, but has periodic projections which in the illustrated embodiment take the form of ribs or ridges 34. These ribs are carefully positioned so that they simultaneously will fall between adjacent ones of the ribs 20 as the two elements are mutually rotated.

In order to be effective either the ribs 20 or the ridges 34 must be resiliently formed to accommodate the other as the elements are mutually rotated. To accomplish this, immediately radially outwardly of each of the ridges 34 is an ovate void 36 passing entirely through the collar. Coupled with the resilient and slightly flexible nature of the material from which the collar is made, these voids permit the outward deformation of the ridges 34 and the immediately surrounding supportive structure as the collar rotates around the trunion pin.

Implementation of the ratchet bearings in a shutter assembly is accomplished as follows. Each of the shutter slats such as slat 38 is provided with an axially bore slightly greater in diameter than the diameter of shaft 14. The collar 10 is engaged on the trunion pin 12, the shoulder 24 being greater in diameter than the inside diameter of interior surface 32 so that the collar is captured on the end of the trunion pin by the conical cap. This assembly is then press-fitted into the bore in the shutter approximately to the depth of the flange 30. Once the ends of all of the shutter slats have been thusly mounted with the ratchet bearings, they are held in position and two side frame members 40 which are predrilled are brought against all of the slats and press-fitted simultaneously against all of the ratchet bearings until they all seat as shown in FIG. 8. Note that the taper of the frustoconical cap 22 is continued at 42 on the collar so that the entire free ends of the ratchet bearings act as guides to easily pilot the assembly into the pre-drilled bores in the shutter frame members.

Action of the shutters utilizing the instant ratchet bearing is positive and secure to firmly establish the position of the slats, and does not rely on a friction journal which loses its friction with repeated use. The tough, low-friction qualities of the material from which the collar and trunion pins are made enables the ratchet bearing to last the life of the shutters.

It should be noted that certain obvious modifications of the invention are intended to be within the scope of the claims. Among these modifications are the interchangeability of the ribs and ridges between the pin and the collar, the modification of the exact shape and number of the detents 34, which could be beads or other shapes, the precise positioning and shape of the voids 36, and other details which could be replaced by their equivalent.

What is claimed is:

1. A ratchet bearing for rotationally mounting a first member relative to a second member and creating a plurality of detent stops throughout at least a portion of the course of relative rotational motion therebetween, said bearing comprising:

(a) a trunnion pin element having one end engageable in a first member and a projection portion defining a generally cylindrical surface;

(b) a bearing collar element with an internal surface at least in part engaged on said cylindrical surface and having means to engage said bearing element in a second member;

(c) said surfaces each defining unitary high and low portions when angularly traversed and at least one of said surfaces being at least in part biased against the other of said surfaces, whereby mutual rotation of said two elements about the axis of said generally cylindrical surface causes successive detention of one element relative to the other element;

(d) one of said surfaces, defining a multiplicity of consecutive longitudinal ribs of the other of said surfaces defines a plurality of detents engaging between consecutive adjacent pairs of said ribs as said elements are mutually rotated causing successive detention of one element relative to the other; and (e) said trunnion pin has at the end thereof opposite said engageable end a tapered tip expanding to a circular shoulder adjacent said cylindrical surface said shoulder being of diameter greater than that of the smallest inside diameter of said internal surface whereby said collar can be retained by said shoulder on said trunnion pin.

2. A ratchet bearing comprising:

(a) a trunnion pin with a generally cylindrical scalloped surface;

(b) a bearing collar engaged on said pin and engaging said scalloped surface;

(c) said pin and collar both having gripping means enabling them to engage non-rotationally in bores in adjacent members made mutually rotational by said bearing;

(d) one end of said trunnion pin defining a shoulder to act as a stop for said collar, and the other end being inserted into a shutter slat to capture said collar; and (e) said pin including a frustoconical cap terminating in said shoulder, and said collar continues the external contour of said cap whereby a pilot pin effect is achieved by said ratchet bearing.

3. A ratchet bearing for rotationally mounting a first member relative to a second member and creating a plurality of detent stops throughout at least a portion of the course of relative rotational motion therebetween, said bearing comprising:

(a) a trunnion pin element having one end engageable in a first member and a projection portion defining a generally cylindrical surface;

(b) a bearing collar element with an internal surface at least in part engaged on said cylindrical surface and having means to engage said bearing element in a second member;

(c) said surfaces each defining unitary high and low portions when angularly traversed and at least one of said surfaces being at least in part biased against the other of said surfaces, whereby mutual rotation of said two elements about the axis of said generally cylindrical surface causes successive detention of one element relative to the other element;

(d) one of said surfaces defining a multiplicity of consecutive longitudinal ribs and the other of said surfaces defining a plurality of detents engaging between consecutive adjacent pairs of said ribs as said elements are mutually rotated causing successive detention of one element relative to the other;

(e) the element defining said detents also defining a plurality of voids behind said detents to permit said detents to be displayed by said ribs as said elements are mutually rotated;

(e) said detents comprising elongated longitudinal ridges and said voids define ovate corridors spanning the length of said ridges and said elements are composed of a resilient material whereby said ridges are biased against compressive forces exerted by said ribs; and (f) said means to engage said collar engages same from one end thereof and the other end of said collar including a radially outwardly directed flange limiting the depth of insertion of said collar into said second member, and said ovate corridors continuing through said flange, defining ovate apertures therein to permit flexure of the entire area underlying said corridors.

* * * * *